United States Patent [19]

Crouzet

[11] 4,362,010

[45] Dec. 7, 1982

[54] FALSE TWIST MACHINE

[75] Inventor: Henri Crouzet, Renaison, France

[73] Assignee: ASA S.A., France

[21] Appl. No.: 184,278

[22] Filed: Sep. 5, 1980

[30] Foreign Application Priority Data

Nov. 16, 1979 [FR] France ..... 79 28861

[51] Int. Cl.[3] ..... D01H 13/04; D01H 13/28

[52] U.S. Cl. ..... 57/279; 57/280; 57/291; 57/308; 57/352

[58] Field of Search ..... 57/279, 280, 290, 291, 57/308, 352, 353

[56] References Cited

U.S. PATENT DOCUMENTS

| | | | |
|---|---|---|---|
| 3,066,471 | 12/1962 | Scragg | 57/308 X |
| 3,942,312 | 3/1976 | Venot | 57/280 |
| 3,999,360 | 12/1976 | Forin et al. | 57/280 |
| 4,051,650 | 10/1977 | Gleyze et al. | 57/290 X |

*Primary Examiner*—Donald Watkins

*Attorney, Agent, or Firm*—Arnold, White & Durkee

[57] ABSTRACT

A yarn texturizing machine in which there are provided a plurality of treatment positions, each position presenting, in operational sequence, a yarn supply device, a first yarn feeder, a yarn heating device, a cooling zone for the heated yarn, a false twist spindle, a second yarn feeder and a windup device. This machine is presenting a central frame on either side of which are symetrically arranged the working positions. A guide tube for the yarn is arranged between the first delivery device and the heater entry, the connection between this tube with the heater being realized by means of a connecting element also joined to a blowing source permitting to eliminate the fumes inside the heater. The connecting element comprises means to the stop of the blowing during the yarn launching operation and to the automatic starting of the blowing action when running normally.

3 Claims, 3 Drawing Figures

FALSE TWIST MACHINE

BACKGROUND OF THE INVENTION

The present invention relates to an improvement to false twist texturing machines and more particularly to machines comprising a closed heater, situated at the top part of the frame and whose entry is out of reach of the operator.

In its U.S. Pat. No. 4,051,650, the applicant has described a false twist texturing machine which offers reduced overall dimensions, particularly in height, and which, in other respects, allows to preserve perceptibly a linear yarn path from the heater entry to the spindle transmitting the false twist.

As a general rule, the machine described in the aforesaid patent comprises a plurality of treatment positions, each position comprising, in operational sequence, a supply for the yarn to be processed, a first delivery device, associated eventually to a yarn drawing system, a heating device (closed heater), a cooling system for the heated yarn, a false twist spindle, a second delivery device, a take-up system, eventually, a yarn thermal setting system with a third delivery device situated immediately before the take-up.

This machine includes a central frame on either side of which are symmetrically arrange the working positions and presents between the yarn supply and the take-up area, a service zone for personnel passage, the first heater, the cooling zone and the yarn entry for the false twist spindle being perceptibly aligned and arranged at least partly above the service zone.

Advantageously, the first heater and the cooling zone are inclined with respect to the horizontal plane and means are provided to guide the yarn from the first delivery device to the heater entry. In the case of a closed heater such as the one illustrated in this patent, these guiding means are essentially constituted by a tube whose entry is near the first delivery device and which is connected to the heater entry. Such development allows to easily thread the yarn by using an aspirating gun which is applied to the heater exit in the same way as it has been realized for a long time in texturing, in particular on the texturing machines commercialized by the SOTEXA Company under the reference of FT 16S or SW 16, machines which reproduce the U.S. Pat. No. 3,501,904.

Eventually, as is indicated in column 5, line 57 to column 6, line 7 of the aforesaid U.S. Pat. No. 4,051,650, the guide tube situated near the first delivery device, can be connected at the heater entry as described in the French Pat. No. 2 248 349 (corresponding to the U.S. Pat. No. 3,942,312).

However, when utilizing such connecting means, and more particularly the one whose connecting element of the heater entry with the guide tube end is also connected to a blowing source permitting to drag the fumes out, it has been observed that during the necessary aspiration operation for machine launching, there occurs within the guide tube a reduction of flow which brings about disturbances during the lacing-up.

These drawbacks occur as with worth machines equipped with horizontal heaters, inclined or vertically mounted heaters.

SUMMARY OF A PREFERRED EMBODIMENT OF THE INVENTION

Now, we have found and this is the object of the present invention, a new type of connecting element between the guide tube and the heater entry which overcomes these drawbacks.

Generally,, the invention deals with an improvment in a false twist texturing machine comprising a plurality of treatment positions, each said position comprising, in operational sequence, a supply of the yarn to be processed, a first delivery device, associated eventually to a yarn drawing system, a heating device constituted by a closed heater, a cooling zone for the heated yarn, a false twist spindle, a secnd delivery device, a take-up, eventually, a yarn thermal setting system with a third delivery device situated immediately before the take-up.

This machine is presenting a central frame on either side of which are arranged symetrically the working positions, and the first heater, the cooling zone and the yarn entry to the false twist spindle being perceptibly aligned, and a guide tube for the yarn being provided between the first delivery device and the heater entry, the connection between this tube and the heater being realized by means of a connecting element also joined to a blowing source allowing to eliminate the fumes from inside the heater.

The improvement according to the invention consists in that the connecting element includes means allowing to:

stop the blowing during the lauching operation, and the automatic restarting of the blowing action when back to normal process.

Going further into the description, the invention will be described for a texturing machine having a general configuration simpler to the one described in the aforesaid U.S. Pat. No. 4,051,650, that is to say including a heater arranged slightly inclined at the upper part of the frame but it is obvious that this is not a limitation and that it could eventually be applied to machines in which the heater, the cooling zone, the spindle would be arranged vertically for example as per U.S. Pat. No. 3,942,312.

In a conception of the invention, the connecting element allowing to join the guide tube to the heater entry is adaptable to the extremities of the aforesaid elements and presents an inlet duct of the fluid source allowing, in normal operation, to deliver a fluid current inside the heater flowing in the same direction as the yarn in order to eliminate the fumes, the aforesaid pipe being equipped with obturation means which will be automatically triggered when the aspiration is applied to the heater exit during the launching operation.

Of course, the invention is not limited to this particular realization mode but also covers all equivalent manners allowing to fullfill the same functions.

DETAILED DESCRIPTION OF A PREFERRED EMBODIMENT OF THE INVENTION

Figure 1:
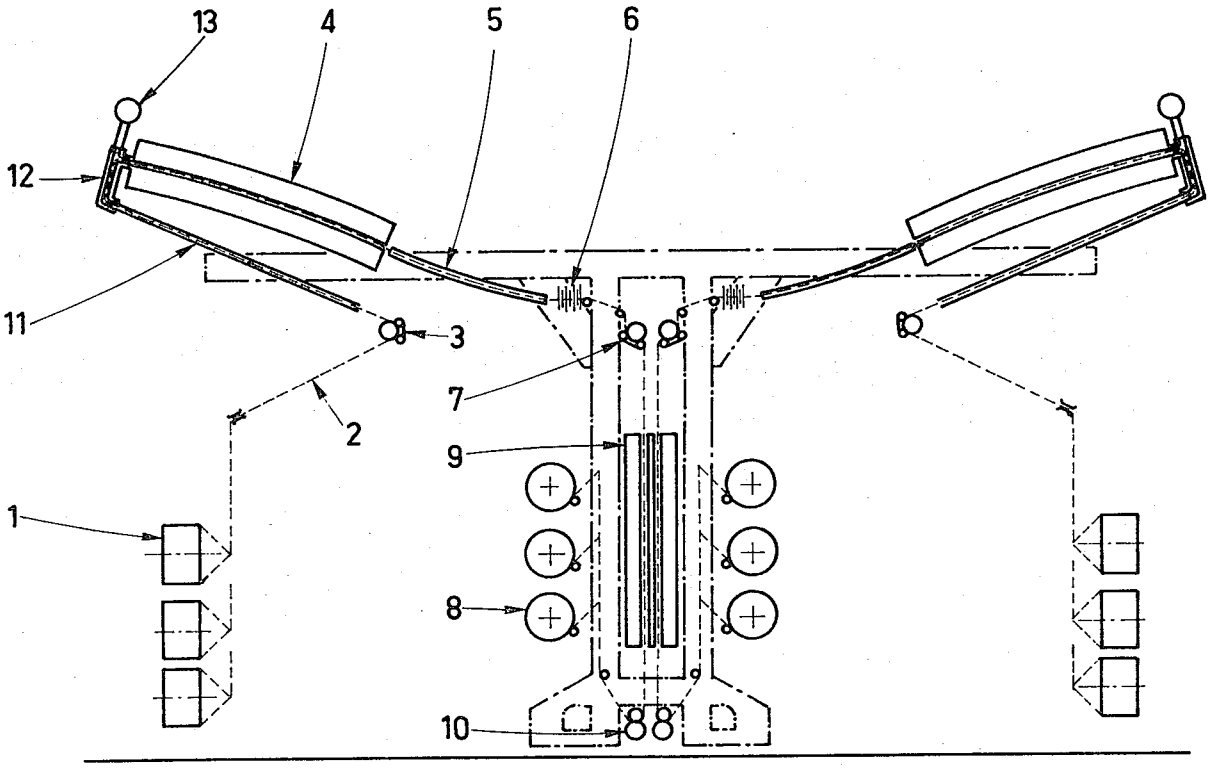
FIG. 1 illustrates schematically, a false twist texturing machine consistent with the invention.

If one refers to the enclosed drawings, FIG. 1 illustrates the machine realized conformably to the invention and which comprises two identical working positions arranged symmetrically on either side of a central frame. Several positions are arranged side-by-side over the machine length.

Each position includes, in operational sequence, one supply 1 for yarn 2 to be processed, a first delivery device 3 associated eventually to a yarn drawing system, a heating device 4 constituted of a conventional closed heater, a cooling zone 5 for the heated yarn, a false twist spindle 6, a second delivery device 7, a take-up 8, and, eventually, as it is represented on this FIG. 1, a thermal setting device 9 with a third delivery device 10 situated immediately before the take-up 8.

The first heater 4, the cooling zone 5 and the yarn entry to the false twist spindle 6 are perceptibly aligned and arranged at the top part of the frame.

A guide tube 11 for yarn 2 is provided between the first delivery device 3 and the entry of heater 4, the connection of this tube 11 with heater 4 being realized by means of a connecting element 12 also connected to a blowing source 13 permitting to eliminate the fumes produced inside heater 4. Preferably, the blowing source 13 extends itself through the whole machine length and is common to all working positions.

Figure 2:
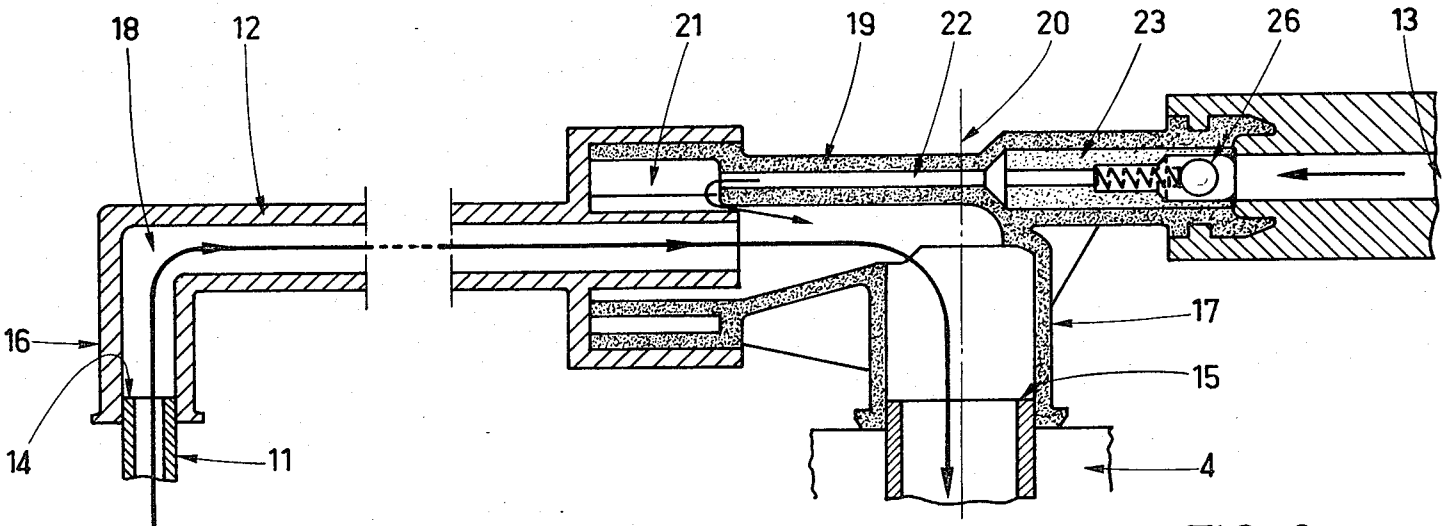
FIG. 2 is a detailed cross section view of the element permitting the junction between the guide tube and the thermal treatment heater.

According to the invention and as it is shown in further detail in FIG. 2, the connecting element 12 is conceived so as to be able to fit one one hand at the extremity 14 of tube 11 and, on the other hand, at the entry 15 of heater 4. In the realization, example illustrated on FIG. 2, this connecting element 12 has perceptibly a U shape whose two branches 16 and 17 are fixed on aforesaid 14 and 15 extremities. A duct 18 is provided in this element 12 in order to allow yarn passage 2.

According to the invention, in the connecting element 12, emerges a blowing fluid supply duct 19 originating from source 13 (non represented in FIG. 2) and which permits to eliminate the fumes produced in heater 4. In this present realization example, this duct 19 is arranged perceptibly parallel to the branch of the connecting element 12 extending between tube 2 and heater 4, but, of course, this is not restrictive and it could be arranged in another manner, for example, perceptibly as axis 20 of heater 4. In the present case, the duct 19 emerges in chamber 21 which has been conceived in such way that the fluid may flow in the same direction as the yarn 2. The duct 19 is equipped, according to the invention, by means permitting the automatic obturation of fluid pipe 22 when an aspiration is applied to the entry of heater 4 during the launching operation, these means being conceived in such way that the fluid will flow normally once the launching operation has been realized.

Figure 3:
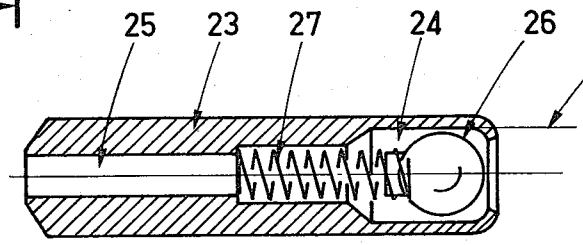
FIG. 3 is an enlarged detailed cross section view of an element permitting to stop the blowing automatically during the launching operation and the restarting during normal operation.

As means for obturating particularly suitable for bringing the invention into effect, one can utilize, as it is shown in more detail in FIG. 3, an assembly incorporating essentially by a part 23, adaptable inside duct 19 and which defines a casing 24 for an obturating element of a tube 5 arranged in the prolongation of tube 22.

This obturating element is constituted by a ball 26 arranged inside casing 24.

This ball which will be the lightest possible and which will be realized for example in a plastic material will be submitted to the action of a calibrated spring 27 which holds it, in normal operation away from pipe 25. Fitting of ball 26 may be realized simply for folding, after inroduction, edges 28 of cavity 24. Of course, cavity 24 and ball 26 have such dimensions that the fluid may flow normally through pipe 23 and later through pipe 22 and heater 4.

Thanks to this conception mode it is possible, when launching to stop the blowing action and to avoid disturbances which occur consequently to a loss of pressure in tube 25. As a matter of fact, when the aspirating gun is applied to the heater exit 4, the ball 26 will obturate the entry of pipe 25 and will therefore stop the blowing fluid flow 13 into heater 4. In return, when the launching operation is realized, the ball, submitted to the action of spring 27 is pushed back into casing 24 and the fluid may flow normally. As an example, an installation has been realized more consistent to the invention having the following characteristics:

diameter of blowing pipe 22–25: 2.4 mm,
ball 26 made of plastic: diameter 7 mm,
diameter of casing 24: 7.5 mm,
diameter of spring 27 located inside cavity: 4.9 mm inside part 23, having 12 whorls made of steel wire of 0.3 mm wound at a pitch of 1.5 mm. The outside diameter of this spring is of 4.5 mm and its length 14 mm unloaded.

It has been observed, that with such a device, the blowing fluid flow for the elimination of the fumes was carried out normally under a pressure of 50 mm water column (5 grams per cm2), the ball kept away from the pipe 23 entry.

In return, during a launching operation, it has been established that it was sufficient to apply an aspiration to the exit of the heater of approximately 1974 mm of water to obtain a correct launching ball then obturating the pipe 23, whereas, without this particularity, it would have been necessary to apply to the heater exit a vaccuum of 2176 water column.

SUMMARY OF ADVANTAGES OF THE INVENTION

This previous example show really the stresses provided by the invention and particularly the fact that is possible to perform the launching operation more easily. Of course, as mentioned previously, the invention is not limited to the example given previously but covers all variations, which could be realized in the same state of mind.

Thus, it could be possible to utilize any other equivalent means instead of a ball submitted to the action of a spring as obturating element when launching.

What is claimed is:

1. A false twisting machine including a number of working positions, each position presenting, in operational sequence:

one supply for the yarn to be processed;
a first delivery device, eventually associated with a yarn drawing attachment;
a heating device comprising a closed heater;
a cooling zone for the heated yarn;
a false twist spindle;
a second delivery device;
a take-up;

the machine having a central frame on either side of which are symetrically arranged the working positions, each working position further having a guide tube for the yarn arranged between the first delivery device and the heater entry;

and each working position having a connecting element connecting the guide tube to the heater entry;

each connecting element having a supply pipe for connection to a blowing source for delivering a fluid current to the inside of the heater to flow in the same direction as yarn during use to remove fumes from the heater, each supply pipe having a cavity of greater dimension than the fluid flow passage of the supply pipe, and each supply pipe having obturating means comprising a ball which is positioned in the cavity and is supported on a calibrated spring for allowing the delivery of fluid current during normal operation but for obturating the fluid flow passage of the supply pipe when the heater exit is aspirated for a yarn launching operation.

2. A machine according to claim 1, in which, at each working position, the heater, the cooling zone and the yarn entry to the false twist spindle are substantially aligned.

3. A machine according to claim 1, in which each working position additionally includes a yarn thermal setting device with a third delivery device positioned before the take-up.

* * * * *